United States Patent [19]

Kern

[11] 4,232,626

[45] Nov. 11, 1980

[54] DEVICE FOR CONTROLLING THE ORIENTATION OF A BOAT IN WATER

[75] Inventor: Klaus Kern, Ennepetal, Fed. Rep. of Germany

[73] Assignee: Firma K & S Baubeschlage Hugo Kruger KG, Gevelsberg, Fed. Rep. of Germany

[21] Appl. No.: 942,623

[22] Filed: Sep. 15, 1978

[30] Foreign Application Priority Data

Sep. 24, 1977 [DE] Fed. Rep. of Germany ..... 2743154

[51] Int. Cl.[3] ..... B63B 1/22

[52] U.S. Cl. ..... 114/285

[58] Field of Search ..... 114/284, 285, 286, 287, 114/144 RE, 144 E, 145 A, 145 R; 244/178, 76 A; 318/585, 588

[56] References Cited

U.S. PATENT DOCUMENTS

| | | | |
|---|---|---|---|
| 1,885,121 | 11/1932 | Loweke | 403/53 |
| 2,491,744 | 12/1949 | Link | 114/281 |
| 2,576,744 | 11/1951 | Anderson | 114/285 |
| 3,327,671 | 6/1967 | Comins | 114/285 |
| 3,391,667 | 7/1968 | Lo Bue | 114/285 |
| 3,493,826 | 2/1970 | Wandrey | 244/178 |
| 3,641,965 | 2/1972 | Schmiedel | 114/286 |
| 3,841,589 | 10/1974 | Appleby et al. | 244/178 |
| 3,866,884 | 6/1975 | Stark et al. | 114/275 |

*Primary Examiner*—Duane A. Reger

*Attorney, Agent, or Firm*—Neuman, Williams, Anderson & Olson

[57] ABSTRACT

In a boat, trimming flaps are pivotally mounted one on each side at the stern and operated by individual electric motors and screw and nut drives enclosed in housings serving as links between the flaps and the boat. The motors are remotely controlled from within the boat.

8 Claims, 5 Drawing Figures

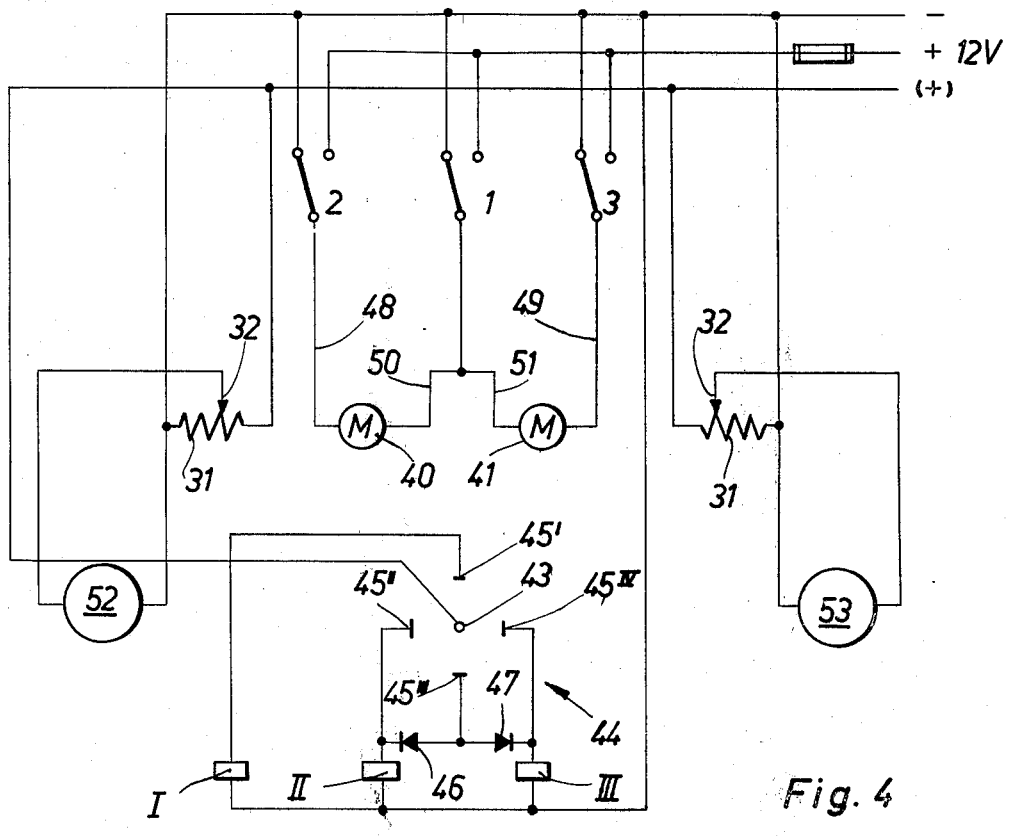
Fig. 4
Fig. 5
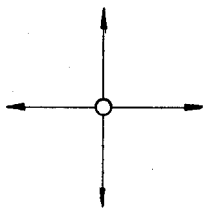

DEVICE FOR CONTROLLING THE ORIENTATION OF A BOAT IN WATER

SUMMARY OF THE INVENTION

The invention refers to a boat including a device controlling the orientation of a boat in water there being trimming flaps arranged at the stern and on both sides of the central longitudinal axis of the boat.

Such devices serve for controlling particularly the gliding orientation in fast travelling boats or for the compensation of heeling arising from side winds or loading arrangements.

An object of the present invention is to provide a device of the aforementioned type which provides a simple and compact and robust construction with a small drive motor requirement, but moreover allows one to also expect a long life with small maintenance costs and renders possible a simple control of the orientation in water.

In accordance with one aspect of the present invention there is provided, in combination a boat having a hull, a pair of trimming flaps located one on each side of the central longitudinal axis of the boat and at the stern thereof, means mounting each said flap on said hull for pivoting movement about a respective axis extending generally transversely of said central axis to different flap angles with respect to said boat, and means for moving a respective flap to different ones of said flap angles, each said moving means including a watertight housing pivotally mounted on the outside of said hull, a remotely controllable low voltage drive motor fixed to said housing on the inside thereof, a drive screw rotatably mounted in said housing and operatively connected to the motor, a nut non-rotatably mounted on said drive screw for movement longitudinally of said screw on rotation thereof, and an adjusting rod extending parallel to said screw in a watertight manner through a wall of said housing having one end thereof connected to said nut and the other end pivotally connected to its respective flap.

Further objects, characteristics and advantages of the invention will become apparent from a study of the accompanying drawings and of the description of an exemplary preferred embodiment given below and of the accompanying claims.

BRIEF DESCRIPTION OF THE DRAWINGS

FIG. 4 is a circuit diagram of the associated remote control device; and

FIG. 5 is a control position diagram for the remote control device.

DESCRIPTION OF A PREFERRED EMBODIMENT

Figure 1:
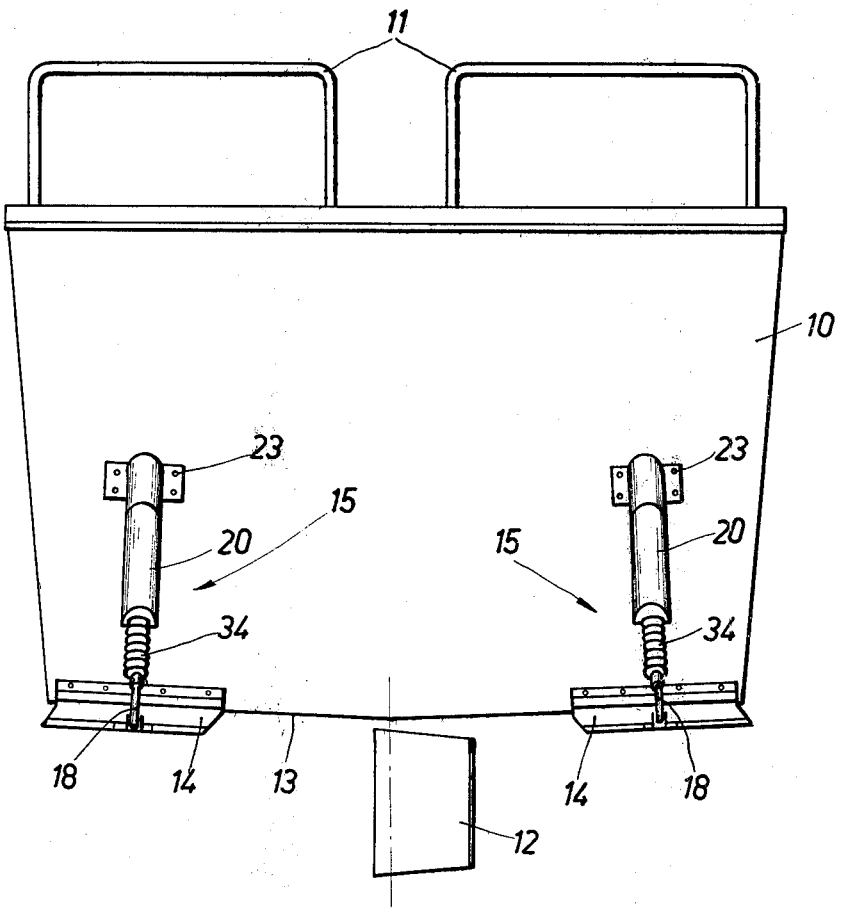
FIG. 1 is a diagrammatic stern view of a boat embodying the present invention.
Figure 2:
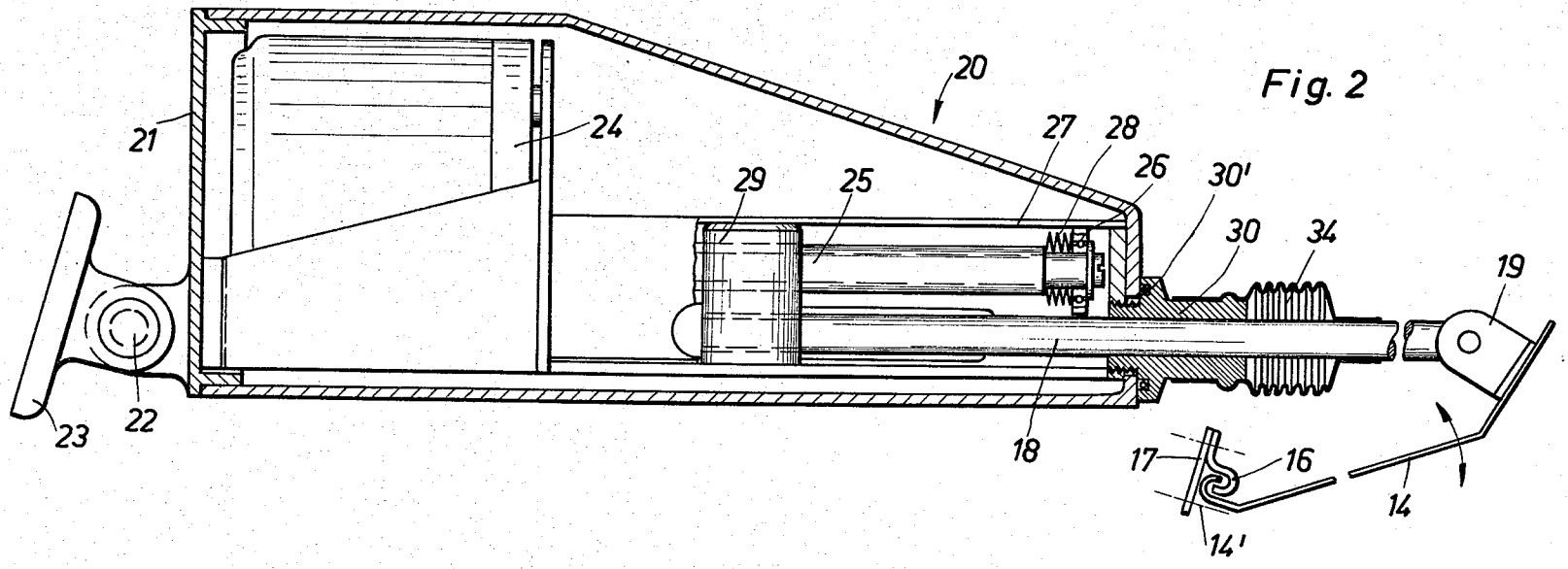
FIG. 2 is a longitudinal section through a flap moving means according to the invention.

Referring now to the embodiment of the invention illustrated in the drawings FIG. 1 shows the stern of a boat having a superstructure 11 and a schematically illustrated rudder 12. To the right and left of the rudder and on the rear lower edges 13 of the hull of the boat, there are arranged trimming flaps 14 which can be angled more or less downwardly by means of associated moving means 15. The trimming flaps 14 are flanged along one of their sides 14' as shown in FIG. 2 and engage in a corresponding oppositely arranged flange 16 which is fixed to a support plate 17 on the stern 10, e.g. through screws. The flange 16 and the flanged side 14' of the trimming flap 14 form a pivot link which permits a pivoting or angling of the trimming flap in both directions indicated by the double arrow shown in FIG. 2, that is, a downward pivoting or an upward pivoting.

The moving means 15 for each flap 14 is of substantially the same construction and will now be described. An adjusting rod 18 is pivotally connected to the edge of the associated trimming flap 14 spaced from the boat and this is done by way of a linking piece 19 fixed to the trimming flap. The adjusting rod 18 is guided in a sealed manner through one end of and into the interior of an enclosed housing 20. The housing 20 has a base plate 21 at its other end opposed to the entry point of the adjusting rod in the housing, which plate is pivotally connected through a link pin 22 with a link piece 23 which is made fast above the fixing of the trimming flap 14 to the stern 10 of the boat as shown in FIG. 1.

A low voltage drive motor 24 is arranged within the enclosed housing 20 and is fixed to the housing plate 21.

The output shaft (not illustrated) of this electric motor drives a threaded spindle or lead screw 25 which is rotatably mounted at its free end by way of a ball-bearing 26 fixed to a housing plate 27. In addition, a spring 28 is arranged in front of the ball-bearing 26 on the free end of this threaded spindle which prevents contact of a nut 29 on the screw with the bearing which might lead to wearing of the bearing. The self-locking type spindle nut 29 is slidable to the right or the left in accordance with the direction of rotation of the low voltage drive motor 24 since it is longitudinally, non-rotatably, guided within the housing 20.

The adjusting rod 18 is fixed to the spindle nut 29 so that this also is slid to the right or left in consequence of sliding of the spindle nut to the right or to the left. As a result the trimming flap 14 is correspondingly swung down or swung up because of the linked connection of the adjusting rod 18 to it and because of the linked connection of the enclosed housing 20 to the hull of the boat.

Figure 3:
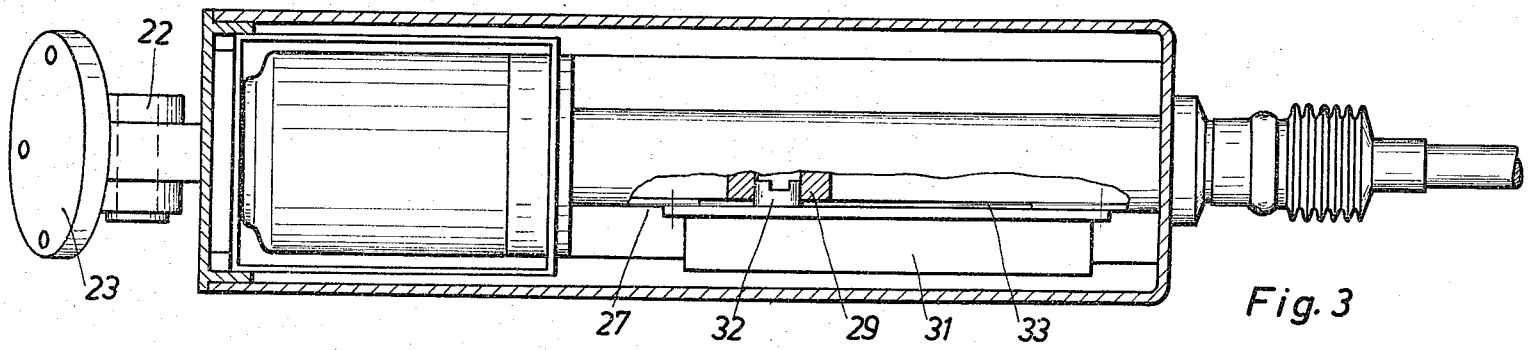
FIG. 3 is a partially sectioned view of the means of FIG. 2.

The housing for the low voltage drive motor must be watertight so that sealing of the adjusting rod 18 with respect to the housing as it is guided outside of the enclosed housing is necessary. To this end a guided bush 30 is provided which is screwed into the end of the longitudinally extended enclosed housing 20 spaced from the boat. A seal 35 is pressed against the enclosed housing by this screwing up. Furthermore, one end of an elastic bellows 34 is fixed in a water-tight manner to the guide bush 30, e.g. through clamping attachments, while the other end is clamped fast in a watertight manner to the adjusting rod 18. The elastic bellows is constructed, for example, as spring-bellows so that it can compensate the changes in the length of the adjusting rod extending outside the housing 20. FIG. 3 shows a position transducer 31 inside the enclosed housing 20 which includes an adjustable pick-up 32 which is connected to the spindle nut 29. The position transducer, constructed as a potentiometer, is screwed to the housing plate 27 which has a slit 33 by means of which the slider or pick-up 32 can be slid backwards and forwards in unhindered manner by the spindle nut during adjusting movements.

The remote control, illustrated in FIG. 4, for both the low voltage drive motors 40, 41 for port and starboard is supplied with 12 volts, a voltage which may always be found present in a motor boat. Obviously also the control can use other direct current voltages by corresponding arrangement of the constructional elements in the case the batteries have corresponding voltages. The hand operable command control 44 is the central control element whose centrally arranged and movable control contact 43 is connected to a positive voltage by, e.g. connection to the winding of a motor of the boat. The central control contact 43 can be brought into current transferring contact with each of the control contacts $45^{I}$ to $45^{Iv}$ spaced about the central contact pivot point. Three command relays I, II, III are present. The command relay I is directly connected with the control contact $45^{I}$, the command relay II is directly connected with the control contact $45^{II}$ and the command relay III is directly connected with the control contact $45^{IV}$. The control contact $45^{III}$ is connected by way of a diode element 46 with the command relay II and by way of a diode element 47 with the command relay III, the two diode elements 46, 47 being arranged in the same sense with respect to the contact $45^{III}$.

The low voltage drive motors 40, 41 have first input or output current lines 48, 49 and second input or output current lines 50, 51. The control contact or switch 2 of the command relay II is located in the current line 48 of the motor 40 so that the current line 48 can be connected as desired to positive or negative DC voltage. Correspondingly, on operation of the command relay III, the current line 49 for the motor 41 in which is located the control contact or switch 3 of this command relay can be connected as required to positive to positive or negative DC voltage. Finally, a switch or contact 1 controlled by command relay I is located in a line common to current lines 50, 51 so that these lines can also be connected as desired (by operation of command control 44 and contact of contacts 43 and $45^{I}$) to positive or negative D.C. voltage. If any one command relay is operated, the associated control contact or switch changes the polarity of selected ones of the current line 50, 51 and the current lines 48, 49 with respect to each other so that one or both the motors 40, 41 rotate in correspondence with their polarisation to the right or the left. As a result the corresponding upward or downward movements are obtained as they are indicated by the control diagram illustrated in FIG. 5.

The control device has a circuit which has small cost as far as constructional elements are concerned and requires little space and is therefore economic. The reversing of the low voltage motors can be obtained in a simple manner with only three command relays. In particular the gliding orientation and the angular orientation of the boat can be precisely controlled during the travel through the common mannual operation of the two trimming flaps.

A supervision of the control device and the trimming flaps is possible for a small constructional cost with the help of indicator devices 52, 53 separated as to port and starboad. These indicator devices are supplied with a direct voltage from the pick ups 32 which cause an indicator device, e.g. a moving coil instrument, to show a greater or lesser value according to the position of the associated pick-up 32 of the potentiometer 31. The control device can be used and supervised in a problem-free manner during a journey because of the position transducers.

I claim:

1. In combination, a boat having a hull, a pair of trimming flaps located one on each side of the central longitudinal axis of the boat and at the stern thereof, means mounting each said flap on said hull for pivoting movement about a respective axis extending generally transversely of said central axis to different flap angles with respect to said boat, and means for moving a respective flap to different ones of said flap angles, each said moving means including a watertight housing pivotally mounted on the outside of said hull, a remotely controllable low voltage drive motor fixed to said housing on the inside thereof, a drive screw rotatably mounted in said housing and operatively connected to the motor, a nut non-rotatably mounted on said drive screw for movement longitudinally of said screw on rotation thereof, and an adjusting rod extending parallel to said screw in a watertight manner through a wall of said housing and having one end thereof connected to said nut and the other end pivotally connected to its respective flap.

2. The combination of claim 1, wherein a guide bush for the adjusting rod is mounted in said wall of said housing, and an elastic bellows has one end attached to the guide bush and its other end attached to the adjusting rod in a watertight manner.

3. The combination of claim 1, wherein a position transducer is located within said housing and is connected between one of said nut and said adjusting rod and said housing.

4. The combination of claim 1 together with a remote control device common to both said moving means, said remote control device having a hand operable controller movable to a respective first position in which both said flaps are movable upwardly with respect to the boat and to respective second, third and fourth positions in which the one or the other flap or both the flaps together can be moved downwardly with respect to the boat.

5. In combination, a boat having a hull; a pair of trimming flaps located one on each side of the central longitudinal axis of the boat and at the stern thereof; means mounting each said flap on said hull for pivoting movement about a respective axis extending generally transversely of said central axis to different flap angles with respect to said boat; and means for moving a respective flap to different ones of said flap angles; each of said moving means including a watertight housing pivotally mounted on the the outside of said hull, a remotely controllable low voltage drive motor fixed to said housing on the inside thereof, a drive screw rotatably mounted in said housing and operatively connected to the motor, a nut nonrotatably mounted on said drive screw for movement longitudinally of said screw on rotation thereof, and an adjusting rod extending parallel to said screw in a watertight manner through a wall of said housing and having one end thereof connected to said nut and the other end pivotally connected to its respective flap; a remote control device common to both said moving means; said remote control device having a hand operable controller movable to a respective first position in which both said flaps are movable upwardly with respect to the boat and to respective second, third and fourth positions in which the one or the other flap or both the flaps together can be moved downwardly with respect to the boat; said remote control device having first and second supply lines for said motors of different polarity and first, second and third relays activatable on movement of said controller to said first, second and third positions to change respective contact positions of first, second and third switches of which the first lines in a common line to one side of the motors and the second and third lie in respective lines to the other side of said motors; in their rest positions all said switches connecting said motors to one said supply line and in their activated position all said switches connecting said motors to the other said supply line.

6. The combination of claim 5 further including first and second diode elements coupled to said second and third relays, respectively, and oriented to permit current flow through said relays in a common direction and wherein, in said fourth position of the controller, said second and third relays are activatable by way of current flowing through the respective diode elements.

7. A combination of claims 4 or 5, wherein a position transducer in the form of a potentiometer is mounted in each said housing and connected to a respective position indicator in said remote control device.

8. For use on a boat, a trimming flap moving means comprising a watertight housing, a remotely controllable low voltage drive motor fixed to said housing on the inside thereof, a drive screw rotatably mounted in said housing and operatively connected to the motor a nut non-rotatably mounted on said drive screw for movement longitudinally of said screw on rotation thereof, and an adjusting rod extending parallel to said screw in a watertight manner through a wall of said housing and having the end thereof within said housing connected to said nut.

* * * * *